US009175533B2

(12) United States Patent
Standridge

(10) Patent No.: US 9,175,533 B2
(45) Date of Patent: Nov. 3, 2015

(54) DRILLABLE SLIP

(71) Applicant: Halliburton Energy Services, Inc., Carrollton, TX (US)

(72) Inventor: William Ellis Standridge, Madill, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 369 days.

(21) Appl. No.: 13/839,523

(22) Filed: Mar. 15, 2013

(65) Prior Publication Data

US 2014/0262344 A1 Sep. 18, 2014

(51) Int. Cl.

| | |
|---|---|
| ***E21B 23/00*** | (2006.01) |
| ***E21B 33/12*** | (2006.01) |
| ***E21B 23/01*** | (2006.01) |
| ***E21B 33/134*** | (2006.01) |
| ***E21B 33/129*** | (2006.01) |

(52) U.S. Cl.

CPC ..... *E21B 23/01* (2013.01); *E21B 33/129* (2013.01); *E21B 33/134* (2013.01)

(58) Field of Classification Search

CPC ..... E21B 33/122; E21B 33/134; E21B 23/01; E21B 33/124; E21B 33/129

USPC ..... 166/206, 207, 208, 382

See application file for complete search history.

(56) References Cited

U.S. PATENT DOCUMENTS

| | | | | |
|---|---|---|---|---|
| 2,043,225 | A | | 6/1936 | Armentrout et al. |
| 2,084,611 | A | | 6/1937 | Crickmer |
| 2,155,129 | A | | 4/1939 | Hall et al. |
| 2,205,119 | A | | 6/1940 | Hall et al. |
| 2,301,624 | A | | 10/1942 | Holt |
| 2,368,428 | A | | 1/1945 | Saurenman |
| 2,368,928 | A | | 2/1945 | King |
| 2,589,506 | A | | 3/1952 | Morriset |
| 2,670,797 | A | | 3/1954 | Armentrout |
| 2,687,775 | A | * | 8/1954 | Baker ..... 166/63 |
| 2,942,665 | A | | 6/1960 | Davis |
| 3,055,424 | A | | 9/1962 | Allen |
| 3,154,145 | A | | 10/1964 | Brown |
| 3,211,227 | A | | 10/1965 | Mott |

(Continued)

FOREIGN PATENT DOCUMENTS

| | | |
|---|---|---|
| EP | 1197632 | 4/2002 |
| WO | WO 2004070163 | 8/2004 |

(Continued)

OTHER PUBLICATIONS

International Search Report and Written Opinion of the International Searching Authority dated Jun. 24, 2014, issued in corresponding PCT Application No. PCT/US2014/010494.

(Continued)

*Primary Examiner* — Kenneth L Thompson

*Assistant Examiner* — Michael Wills, III

(74) *Attorney, Agent, or Firm* — McAfee & Taft. PC

(57) ABSTRACT

This invention particularly relates to improving the engagement of the slip elements within a casing or tubing. Particularly, the invention is directed to improving the penetration of anchors on slip elements to better set downhole tools. Generally, in one aspect, the invention relies on decreasing the contact surface of the cutting edge of the anchor during the initial penetration of the anchor into the casing.

22 Claims, 12 Drawing Sheets

(56) References Cited

U.S. PATENT DOCUMENTS

| | | | | |
|---|---|---|---|---|
| 3,223,169 | A | 12/1965 | Roark | |
| 3,239,008 | A | 3/1966 | Leutwyler | |
| 3,306,366 | A | 2/1967 | Muse | |
| 3,339,637 | A | 9/1967 | Holden | |
| 3,412,802 | A | 11/1968 | Stachowiak | |
| 3,433,301 | A | 3/1969 | McEver, Jr. | |
| 3,529,667 | A | 9/1970 | Malone | |
| 3,531,716 | A | 9/1970 | Tarui et al. | |
| 3,584,684 | A | 6/1971 | Anderson et al. | |
| 3,731,776 | A | 5/1973 | Fisher | |
| 3,910,348 | A | 10/1975 | Pitts | |
| 3,951,211 | A | 4/1976 | Ellis | |
| 4,067,358 | A | 1/1978 | Streich | |
| 4,127,168 | A | 11/1978 | Hanson et al. | |
| 4,151,875 | A | 5/1979 | Sullaway | |
| 4,156,460 | A | 5/1979 | Crowe | |
| 4,176,715 | A | 12/1979 | Bigelow et al. | |
| 4,185,689 | A | 1/1980 | Harris | |
| 4,285,458 | A | 8/1981 | Stevens | |
| 4,288,082 | A | 9/1981 | Setterberg, Jr. | |
| 4,300,631 | A | 11/1981 | Sainato et al. | |
| 4,302,018 | A | 11/1981 | Harvey et al. | |
| 4,349,071 | A | 9/1982 | Fish | |
| 4,457,369 | A | 7/1984 | Henderson | |
| 4,516,634 | A | 5/1985 | Pitts | |
| 4,573,537 | A | 3/1986 | Hirasuna et al. | |
| 4,582,134 | A | 4/1986 | Gano et al. | |
| 4,682,724 | A | 7/1987 | Hahn | |
| 4,708,202 | A | 11/1987 | Sukup et al. | |
| 4,730,670 | A | 3/1988 | Kim | |
| 4,753,444 | A | 6/1988 | Jackson et al. | |
| 4,756,364 | A | 7/1988 | Christensen et al. | |
| 4,765,404 | A | 8/1988 | Bailey et al. | |
| 4,784,226 | A | 11/1988 | Wyatt | |
| 4,794,989 | A | 1/1989 | Mills | |
| 4,808,275 | A | 2/1989 | Ohzora et al. | |
| 4,834,184 | A | 5/1989 | Streich et al. | |
| 4,840,230 | A | 6/1989 | Youd et al. | |
| 4,968,184 | A | 11/1990 | Reid | |
| 4,977,958 | A | 12/1990 | Miller | |
| 5,044,434 | A | 9/1991 | Burns, Sr. et al. | |
| 5,056,630 | A | 10/1991 | Fujii et al. | |
| 5,101,897 | A | 4/1992 | Leismer et al. | |
| 5,103,904 | A | 4/1992 | Luke et al. | |
| 5,131,468 | A | 7/1992 | Lane et al. | |
| 5,178,219 | A | 1/1993 | Striech et al. | |
| 5,224,540 | A | 7/1993 | Streich et al. | |
| 5,258,706 | A | 11/1993 | Brunner et al. | |
| 5,268,638 | A | 12/1993 | Brunner et al. | |
| 5,271,468 | A | 12/1993 | Streich et al. | |
| 5,271,959 | A | 12/1993 | Bober et al. | |
| 5,311,938 | A | 5/1994 | Hendrickson et al. | |
| 5,327,975 | A | 7/1994 | Land | |
| 5,343,954 | A | 9/1994 | Bohlen et al. | |
| 5,390,737 | A | 2/1995 | Jacobi et al. | |
| 5,404,110 | A | 4/1995 | Golladay | |
| 5,404,956 | A | 4/1995 | Bohlen et al. | |
| 5,431,230 | A | 7/1995 | Land et al. | |
| 5,433,269 | A | 7/1995 | Hendrickson | |
| 5,451,084 | A | 9/1995 | Jansch | |
| 5,456,322 | A | 10/1995 | Tucker et al. | |
| 5,492,173 | A | 2/1996 | Kilgore et al. | |
| 5,501,281 | A | 3/1996 | White et al. | |
| 5,540,279 | A | 7/1996 | Branch et al. | |
| 5,603,511 | A | 2/1997 | Keyser, Jr. et al. | |
| 5,663,967 | A | 9/1997 | Lindberg et al. | |
| 5,676,384 | A | 10/1997 | Culpepper | |
| 5,701,954 | A | 12/1997 | Kilgore et al. | |
| 5,701,959 | A | 12/1997 | Hushbeck et al. | |
| 5,720,343 | A | 2/1998 | Kilgore et al. | |
| 5,839,515 | A | 11/1998 | Yuan et al. | |
| 5,857,510 | A | 1/1999 | Krupke et al. | |
| 5,857,520 | A | 1/1999 | Mullen et al. | |
| 5,878,849 | A | 3/1999 | Prunier, Jr. et al. | |
| 5,904,354 | A | 5/1999 | Collins | |
| 5,944,102 | A | 8/1999 | Kilgore et al. | |
| 5,984,007 | A | 11/1999 | Yuan et al. | |
| 6,102,117 | A | 8/2000 | Swor et al. | |
| 6,112,811 | A | 9/2000 | Kilgore et al. | |
| 6,132,844 | A | 10/2000 | Altshuler et al. | |
| 6,167,963 | B1 * | 1/2001 | McMahan et al. | 166/179 |
| 6,220,349 | B1 | 4/2001 | Vargus et al. | |
| 6,267,180 | B1 | 7/2001 | Gazda et al. | |
| 6,302,217 | B1 | 10/2001 | Kilgore et al. | |
| 6,315,041 | B1 | 11/2001 | Carlisle et al. | |
| 6,318,460 | B1 | 11/2001 | Swor et al. | |
| 6,394,180 | B1 | 5/2002 | Berscheidt et al. | |
| 6,474,419 | B2 | 11/2002 | Maier et al. | |
| 6,481,497 | B2 | 11/2002 | Swor et al. | |
| 6,491,116 | B2 | 12/2002 | Berscheidt et al. | |
| 6,513,600 | B2 | 2/2003 | Ross | |
| 6,598,672 | B2 | 7/2003 | Bell et al. | |
| 6,695,050 | B2 | 2/2004 | Winslow et al. | |
| 6,695,051 | B2 | 2/2004 | Smith et al. | |
| 6,708,770 | B2 | 3/2004 | Slup et al. | |
| 6,793,022 | B2 | 9/2004 | Vick et al. | |
| 6,827,150 | B2 | 12/2004 | Luke | |
| 7,048,066 | B2 | 5/2006 | Ringgenberg et al. | |
| 7,255,178 | B2 | 8/2007 | Slup et al. | |
| 7,373,973 | B2 | 5/2008 | Smith et al. | |
| 7,472,746 | B2 | 1/2009 | Maier | |
| 7,735,549 | B1 * | 6/2010 | Nish et al. | 166/134 |
| 7,779,927 | B2 | 8/2010 | Turley et al. | |
| 8,701,787 | B2 | 4/2014 | Shkurti et al. | |
| 2002/0062962 | A1 | 5/2002 | Gary et al. | |
| 2002/0088616 | A1 | 7/2002 | Swor et al. | |
| 2003/0098164 | A1 | 5/2003 | Hirth | |
| 2003/0188876 | A1 | 10/2003 | Vick et al. | |
| 2003/0226660 | A1 | 12/2003 | Winslow et al. | |
| 2004/0045723 | A1 | 3/2004 | Slup et al. | |
| 2005/0121202 | A1 | 6/2005 | Abercrombie Simpson et al. | |
| 2005/0173126 | A1 | 8/2005 | Starr et al. | |
| 2005/0189103 | A1 | 9/2005 | Roberts et al. | |
| 2005/0230123 | A1 | 10/2005 | Waddell et al. | |
| 2006/0021748 | A1 | 2/2006 | Swor et al. | |
| 2006/0232019 | A1 | 10/2006 | Garrison et al. | |
| 2006/0289173 | A1 | 12/2006 | Conaway et al. | |
| 2008/0060821 | A1 | 3/2008 | Smith et al. | |
| 2009/0038790 | A1 | 2/2009 | Barlow | |
| 2012/0097384 | A1 | 4/2012 | Valencia et al. | |
| 2012/0255723 | A1 | 10/2012 | Standridge | |
| 2013/0112412 | A1 * | 5/2013 | Frazier | 166/298 |
| 2014/0020911 | A1 * | 1/2014 | Martinez | 166/387 |

FOREIGN PATENT DOCUMENTS

| | | |
|---|---|---|
| WO | 2007058864 A1 | 5/2007 |
| WO | WO 2009019483 | 2/2009 |

OTHER PUBLICATIONS

Halliburton Sales & Service Catalog 43, pp. 2561-2562 and 2556-2557 (1985).

Magnum Oil Tools International, brochure titled "Rapid Mill Ball Drop Frac Plug", undated but admitted to be prior art.

Weatherford International Ltd., brochure titled "HBP Hydro-Mechanical Bridge Plug" (2007).

ITT Corporation, Web pages at http://es.is.itt.com/CompositeBearClaw.htm, titled "Advanced Composite Structures & Subsystems" viewed on Aug. 30, 2010.

Halliburton Energy Services, Inc., brochure pages titled Speedy Line 11 Frac Plug, Jul. 1, 2011.

* cited by examiner

DRILLABLE SLIP

BACKGROUND OF THE INVENTION

1. Field of the Invention

This invention relates generally to downhole tools for use in oil and gas wellbores and methods of anchoring such apparatuses within the casing of the wellbore. This invention particularly relates to improving the engagement of the slip elements within a casing or tubing. These slip elements are commonly used in setting or anchoring of a downhole drillable packer, bridge plug and frac plug tools.

2. Description of Related Art

In drilling or reworking oil wells, many varieties of downhole tools are used. For example, but not by way of limitation, it is often desirable to seal tubing or other pipe in the casing of the well by pumping cement or other slurry down the tubing, and forcing the slurry around the annulus of the tubing or out into a formation. It then becomes necessary to seal the tubing with respect to the well casing and to prevent the fluid pressure of the slurry from lifting the tubing out of the well, or for otherwise isolating specific zones in a well. Downhole tools referred to as packers, bridge plugs and frac plugs are designed for these general purposes, and are well known in the art of producing oil and gas.

Both packers and bridge plugs are used to isolate the portion of the well below the packer or bridge plug from the portion of the well thereabove. Accordingly, packers and bridge plugs may experience a high differential pressure, and must be capable of withstanding the pressure so that the packer or bridge plug seals the well, and does not move in the well after being set.

Packers and bridge plugs used with a downhole tool both make use of metallic or non-metallic slip assemblies, or slips, that are initially retained in close proximity to a mandrel. These packers and bridge plugs are forced outwardly away from the mandrel upon the downhole tool being set to engage a casing previously installed within an open wellbore. Upon positioning the downhole tool at the desired depth, or position, a setting tool or other means of exerting force, or loading, upon the downhole tool forces the slips to expand radially outward against the inside of the casing to anchor the packer, or bridge plug, so that the downhole tool will not move relative to the casing. Once set, additional force, in the form of increased hydraulic pressure, is commonly applied to further set the downhole tool. Unfortunately, the increased pressure commonly causes the downhole tool to slip up or down the casing.

To prevent slipping of the downhole tool, cylindrically shaped inserts, or buttons, are secured to the slip segments to enhance the ability of the slip segments to engage the well casing. The buttons must be of sufficient hardness to be able to partially penetrate, or bite into the surface of the well casing, which is typically steel. Unfortunately, the buttons will occasionally disintegrate under increased force, or higher pressures, thereby allowing the downhole tool to slide within the well.

Alternatively, the slip segments may have a plurality of wickers positioned about them to engage and secure the slip segments within the casing. The wickers must be sufficiently hard to engage and deformably cut into the well casing. Unfortunately, the amount of force required to cause the plurality of wickers to engage the well casing is significant, and often exceeds that of a setting tool. Thus, until sufficient force is exerted upon the wickers, the wickers may not fully engage the casing, thereby allowing the tool to slide significant distances within the well prior to engaging the casing.

SUMMARY OF THE INVENTION

In accordance with one embodiment of the invention there is provided a slip ring for anchoring a downhole tool in a wellbore casing having an inner wall, the slip ring comprising two or more slip segments, two or more grooves and a plurality of generally circumferentially extending wickers. The slip segments are integrally formed into the slip ring and each slip segment has an outer surface. The grooves are grooves longitudinally positioned between the slip segments. A first portion of the grooves define fracture channels such that the slip segments are frangiblely connected together. The slip segments will separate along the first portion of the grooves upon application of a predetermined primary radial force. The generally circumferentially extending wickers are located upon each the outer surfaces of the slip segments. Each wicker has a cutting edge. Each slip segment has a longitudinally extending centerline and each slip segment and each wicker is configured such that, upon expansion of the slip ring in the casing, a contact point on the cutting edge and at or near the centerline will meet the casing before any portion of the cutting edge at or near the groove.

In accordance with another embodiment of the invention there is provide a method of anchoring a downhole tool in a wellbore casing comprising:

- introducing the downhole tool into the casing wherein the downhole tool has a mandrel, a slip ring positioned on the mandrel and a slip wedge positioned on the mandrel, wherein the slip ring comprises:
  - two or more slip segments integrally formed into the slip ring to produce a central aperture adapted to receive the mandrel, the slip segments having an outer surface and;
  - two or more grooves longitudinally positioned between the slip segments, wherein a first portion of the grooves define fracture channels such that the slip segments are frangiblely connected together and the slip segments will separate along the first portion of the grooves upon application of a predetermined primary radial force; and
  - a plurality of generally circumferentially extending wickers upon the outer surface wherein each wicker has a cutting edge; and wherein each slip segment has a longitudinally extending centerline; and wherein each slip segment and each wicker is configured such that, upon expansion of the slip ring in the casing, a contact point on the cutting edge and at or near the centerline will meet the casing before any portion of the cutting edge at or near the groove;
- positioning the downhole tool at a desired location;
- applying a setting force to the downhole tool such that the slip wedge engages the slip ring so as to provide a radial force at least equal to the predetermined primary radial force to the slip ring and thus causing the contact point to penetrate the casing; and
- increasing the radial force applied to the slip ring such that the majority of the cutting edge penetrates the casing.

In accordance with yet another embodiment of the invention there is provided slip ring for anchoring a downhole tool in a wellbore casing having an inner wall, the slip ring comprising four or more slip segments, two or more primary grooves, two or more secondary grooves and a plurality of anchors. The slip segments are integrally formed into the slip ring and each slip segment has an outer surface. The primary grooves are longitudinally positioned between the slip segments. The primary grooves define fracture channels such that the slip segments are frangiblely connected and the slip segments will separate along the primary grooves into pairs upon application of a predetermined primary radial force. The secondary grooves are longitudinally positioned between the slip segments forming the pairs. The secondary grooves define fracture channels such that the pairs of slip segments are frangiblely connected and will separate upon application of a predetermined secondary radial force and wherein the predetermined secondary radial force is greater than the predetermined primary radial force. The anchors are located upon the outer surface. Each slip segment has a longitudinally extending centerline. Each slip segment and each wicker is configured such that, upon expansion of the slip ring by the predetermined primary radial force in the casing, the anchors near will meet the inner wall of the casing.

In accordance with still another embodiment of the invention there is provide a method of anchoring a downhole tool in a wellbore casing comprising:

introducing the downhole tool into the casing wherein the downhole tool has a mandrel, a slip ring positioned on the mandrel and a slip wedge positioned on the mandrel, wherein the slip ring comprises:

four or more slip segments integrally formed into the slip, wherein each slip segment has an outer surface;

two or more primary grooves longitudinally positioned between the slip segments wherein the primary grooves define fracture channels such that the slip segments are frangiblely connected and the slip segments will separate along the primary grooves into pairs upon application of a predetermined primary radial force;

two or more secondary grooves longitudinally positioned between the slip segments forming the pairs wherein the secondary grooves define fracture channels such that the pairs of slip segments are frangiblely connected and will separate upon application of a predetermined secondary radial force wherein the predetermined secondary radial force is greater than the predetermined primary radial force; and a plurality anchors upon the outer surface; and wherein each slip segment has a longitudinally extending centerline; and wherein each slip segment and each wicker is configured such that, upon expansion of the slip ring by the predetermined primary radial force in the casing, the anchors near will meet the inner wall of the casing;

positioning the downhole tool at a desired location; and applying a setting force to the downhole tool such that the slip wedge engages the slip ring so as to provide a radial force at least equal to the predetermined primary radial force to the slip ring and thus causing the anchors to penetrate the casing.

BRIEF DESCRIPTION OF THE DRAWINGS

FIG. 6 is a cross-sectional view of the slip ring taken along section 6-6 of FIG. 5.

FIG. 16 is a bottom perspective view of a slip ring in accordance with still another embodiment of the current invention.

DESCRIPTION OF THE PREFERRED EMBODIMENTS

Figure 1:
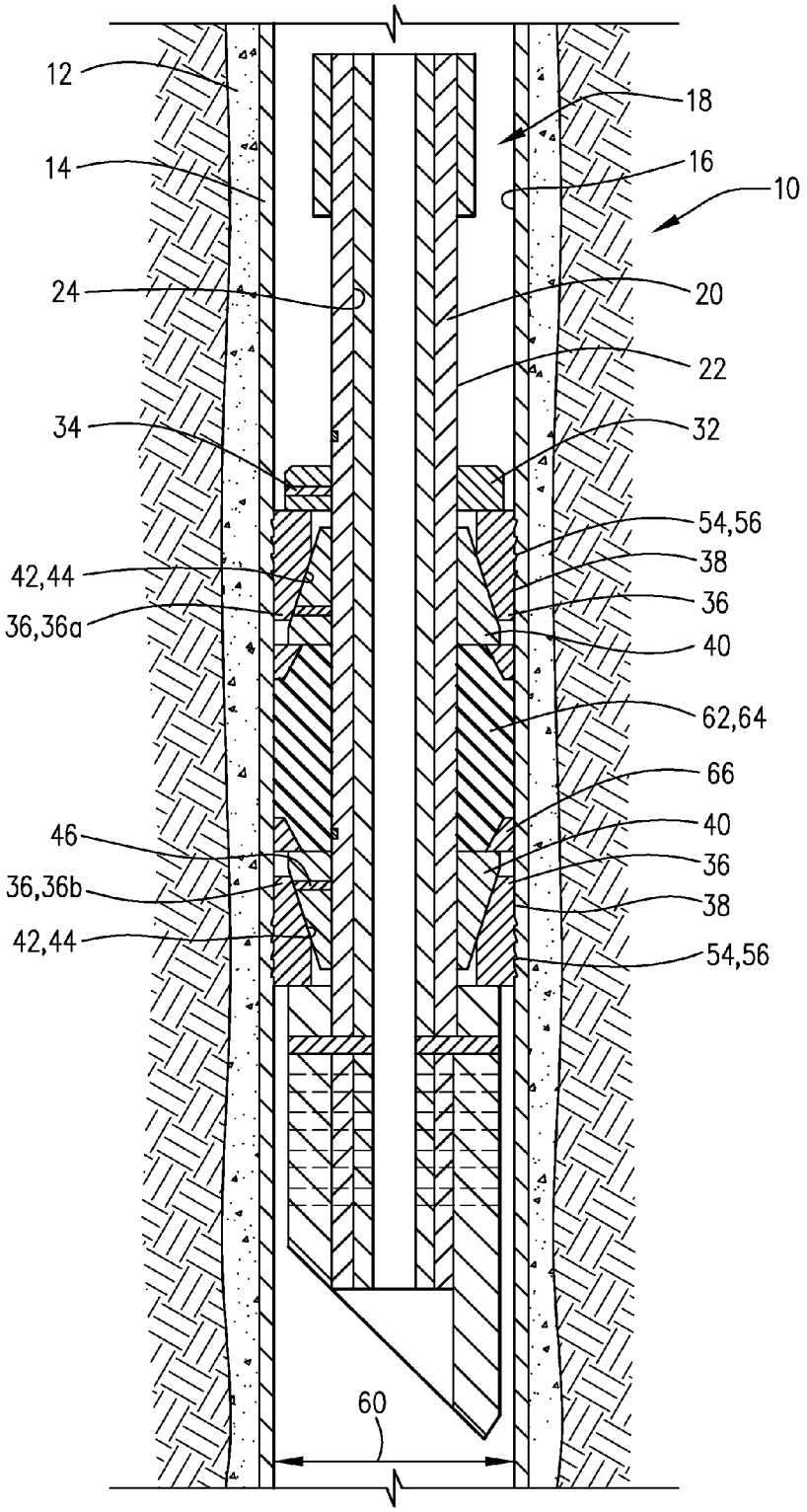
FIG. 1 is a cross-section of a downhole tool disposed in a well with a slip assembly.

Referring to the drawings, FIG. 1 illustrates well 10 having wellbore 12 with casing 14 cemented therein. Casing 14 has inner wall 16. Downhole tool 18 includes mandrel 20 with an outer surface 22 and an inner surface 24.

Figure 2:
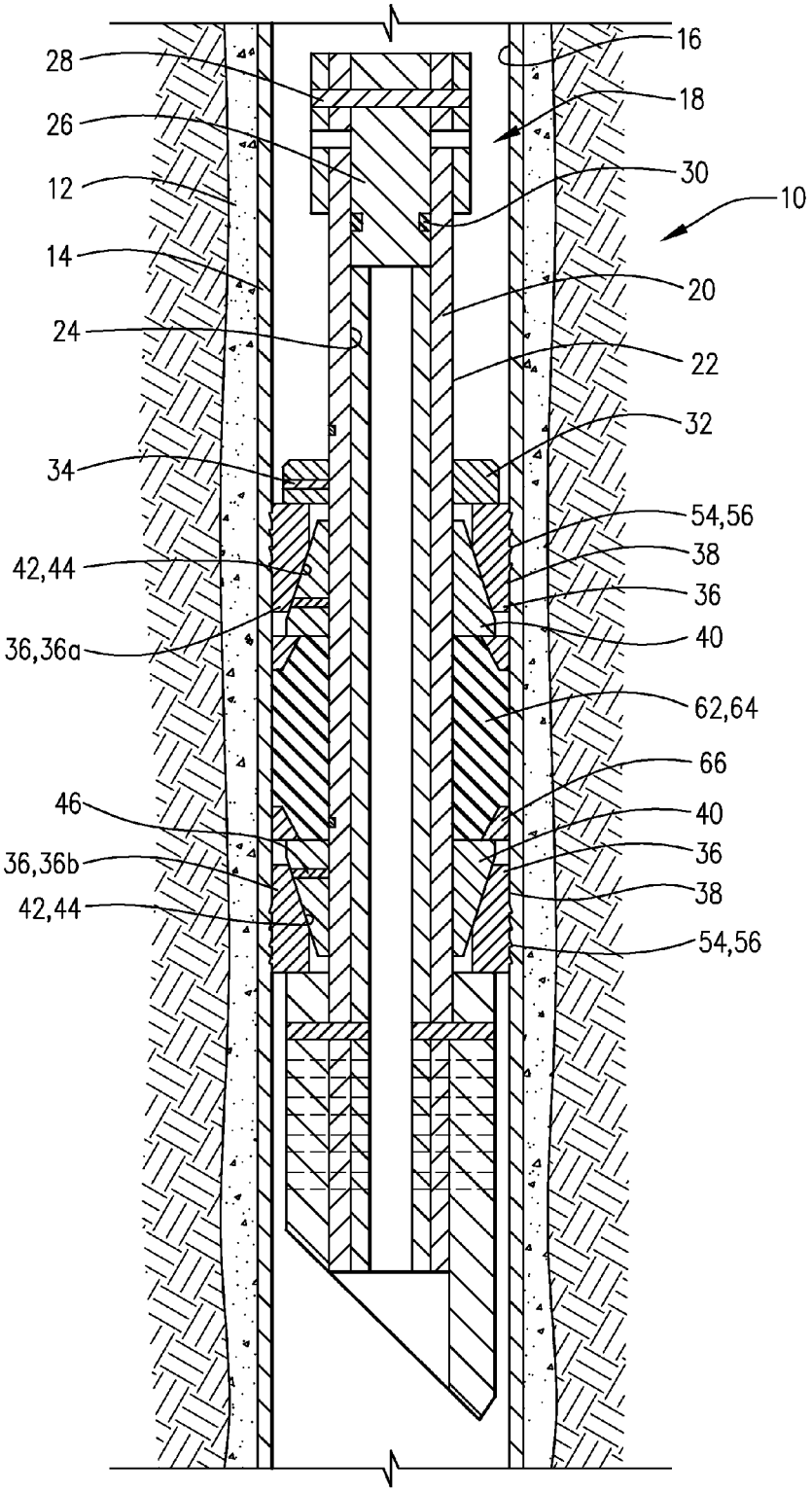
FIG. 2 is a cross-section of an alternative downhole tool disposed in a well with a slip assembly.

By way of a non-limiting example, downhole tool 18 illustrated in FIG. 1 is referred to as a packer, and allows fluid communication therethrough. The packer illustrated may be used as a frac plug. In another non-limiting example, downhole tool 18 illustrated in FIG. 2 is referred to as bridge plug. For this second non-limiting example, downhole tool 18 has optional plug 26 pinned within mandrel 20 by radially oriented pins 28. Plug 26 has a seal 30 located between plug 26 and mandrel 20. Without plug 26, downhole tool 18 is suited for use as, and referred to as a packer.

As illustrated in FIGS. 1 and 2, spacer ring 32 is mounted to mandrel 20 with a pin 34. Slip assembly 36 is positioned on and/or disposed about mandrel 20. Spacer ring 32 provides an abutment, which serves to axially retain slip assembly 36. As illustrated in FIGS. 1 and 2, downhole tool 18 has two slip assemblies 36, namely a first slip assembly and second slip assembly, depicted in FIGS. 1 and 2 as first and second slip assemblies **36*a* and 36*b* for ease of reference. Slip assemblies 36*a* and 36*b* provide anchoring for downhole tool 18 to casing 14 within well 10. The structure of slip assemblies 36*a* and 36*b* is typically identical, and only the orientation and position on downhole tool 18 are different. Each slip assembly 36 includes at least one slip ring 38 and at least one slip wedge 40. Slip ring 38 has an inclined/wedge-shaped first surface 42** positioned proximate to an inclined/wedge-shaped complementary second surface 44 of slip wedge 40. Slip assembly 36 is depicted as being pinned into place with pins 46.

Slip assemblies 36*a* and 36*b* are illustrated in FIGS. 1 and 2 as being separated by packer element assembly 62. As illustrated, packer element assembly 62 includes at least one expandable packer element 64, which is positioned between slip wedges 40. Packer shoes 66 may provide axial support to the ends of packer element assembly 62.

Figure 3:
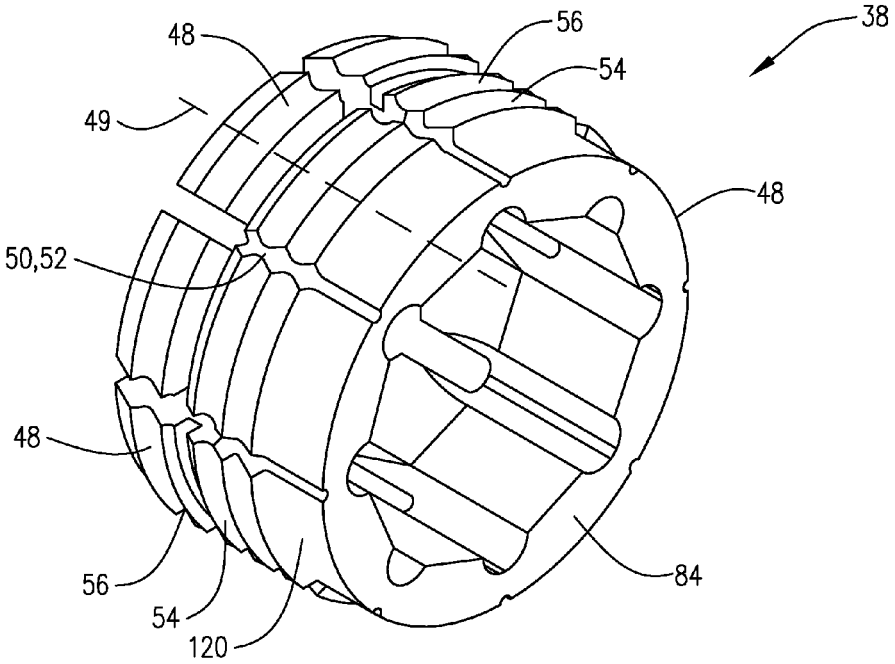
FIG. 3 is a bottom perspective view of a slip ring in accordance with one embodiment of the current invention.
Figure 4:
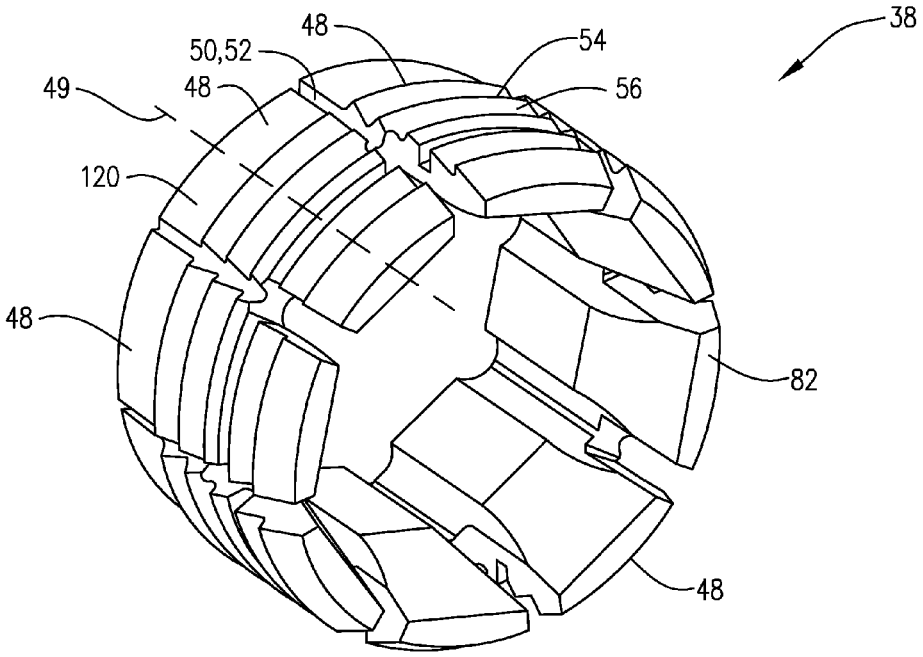
FIG. 4 is a top perspective view of the slip ring in accordance with the embodiment of FIG. 4.
Figure 5:
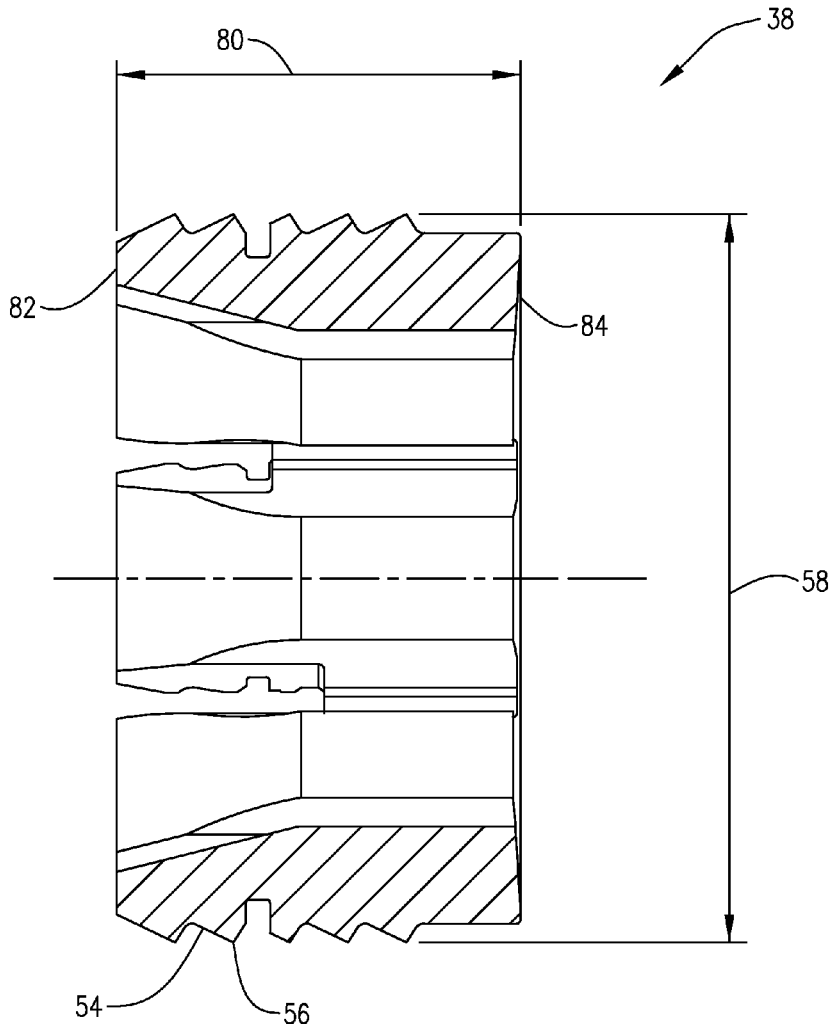
FIG. 5 is a top view of the slip ring of the embodiment of FIGS. 3 and 4

Slip ring 38, shown in FIGS. 3-6, is an expandable slip ring 38 and has a plurality of slip segments 48. Slip segments 48 are separated by a groove 50, which is also a fracture channel 52. Groove 50 and fracture channel 52 is longitudinally or axially positioned between slip segments 48 and provides a weakened point in slip ring 38 for slip segments 48 to break apart from each other when sufficient forces are radially exerted on the interior of slip ring 38. Thus, the slip segments are frangiblely connected together and the slip segments will separate along grooves 50 when a predetermined radial force is applied. Without limiting the invention, slip ring 38 may include a plurality of slip segments 48. Collectively, all slip segments 48 make up a circumferential slip ring 38. Preferably, slip ring 38 has at least one circumferential pair of slip segments 48 with at least one fracture channel 52 positioned therebetween. As illustrated in FIGS. 3-5, slip ring 38 has eight slip segments 48. Slip ring 38 also has first or top end 82 and second or bottom end 84. First end 82 is adapted to receive slip wedge 40.

As illustrated in FIGS. 3-6, slip ring 38 is a one piece or unitary slip ring; that is, the slip ring is integrally formed from a single material without the need to bond individually formed segments together or hold individually formed segments together by the use of frangible retaining rings. Although slip ring 38 is illustrated as a fracturable unitary slip ring, it is within the scope of the invention to form slip ring 38 from separate slip segments 48. In this configuration, all of slip segments 48 typically are secured by frangible retaining rings; however, they can be bonded together by a frangible material.

Slip rings 38 are comprised of a drillable material and may be, for example, cast iron or a molded phenolic. Slip rings 38 may be made from other drillable materials such as drillable metals, composites and engineering grade plastics. The remainder of slip assembly 34 and other components of the tool may likewise be made from drillable materials.

Preferably, each slip segment 48 has defined at least one anchor on outer surface 120 thereof. As illustrated, the anchors are a plurality of wickers 54 defined on the outer surface 120 of each slip segment 48. The number of wickers 54 on each slip bank 48 is determined by the size of casing 14 and the pressure slip ring 38 is designed to resist. The non-limiting example illustrated in FIGS. 3-6 shows each slip segment 48 having five wickers defined thereon. As illustrated, wicker 54 generally circumferentially extends across outer surface 120. Wicker 54 has cutting edge 56 extending therefrom and oriented towards casing inner wall 16. Preferably, wickers 54 are integrally formed from slip ring 38. In the alternative, wickers 54 may be secured to slip ring 38, or inserted into slip ring 38 by other means known to those skilled in the art.

As can be seen best from FIG. 6, a section view of FIG. 5 is illustrated and provides exemplary angles and measurements for a slip ring 38 designed for use in a 4.5 inch (about 11.43 centimeters) outer diameter casing having an inner diameter 60 of about 4.04 inches (10.26 centimeters). In this example, outer diameter 58 of slip ring 38 is about 3.5 inches (8.89 centimeters) and height 80 of about 1.95 inches (4.95 centimeters).

Wickers 54 are positioned on slip segment 48 such that a contact point 57 on each cutting edge 56 first contacts casing inner wall 16. In other words, when a predetermined radial force separates the slip segments 48 and radially expands them, contact point 57 will meet the casing before any portion of said cutting edge 56 at or near the groove. Thereby, upon separation the contact point will initially exert all the force upon casing inner wall 16 for the wicker. Thus, the initial biting capability of slip segment 48 is improved and when pressure is applied to the plug it allows the wicker to bite deeper and subsequently for more area to penetrate and/or deformably cut into casing inner wall 16. The initial penetration and/or deformation of casing inner wall 16 by cutting edge 56 is hereinafter called "bite". It has been found that wicker penetration can be an issue for harder casings, such as P-110 grade and harder. More wicker area requires more force to start the bite into the casing. Accordingly, in one embodiment of the invention, wickers 54 are made to have a cutting edge with only a few contact points, which will meet the casing before the rest of the cutting edge, then the wicker area for the initial bite into the casing will be less and will require less force than for penetration of the entire cutting edge at once. This action securely anchors downhole tool 18 for harder casings grades. Casing grades are the industry standardized measures of casing-strength properties. Since most oilfield casing is of approximately the same chemistry (typically steel), and differs only in the heat treatment applied, the grading system provides for standardized strengths of casing to be manufactured and used in wellbores.

Figure 8:
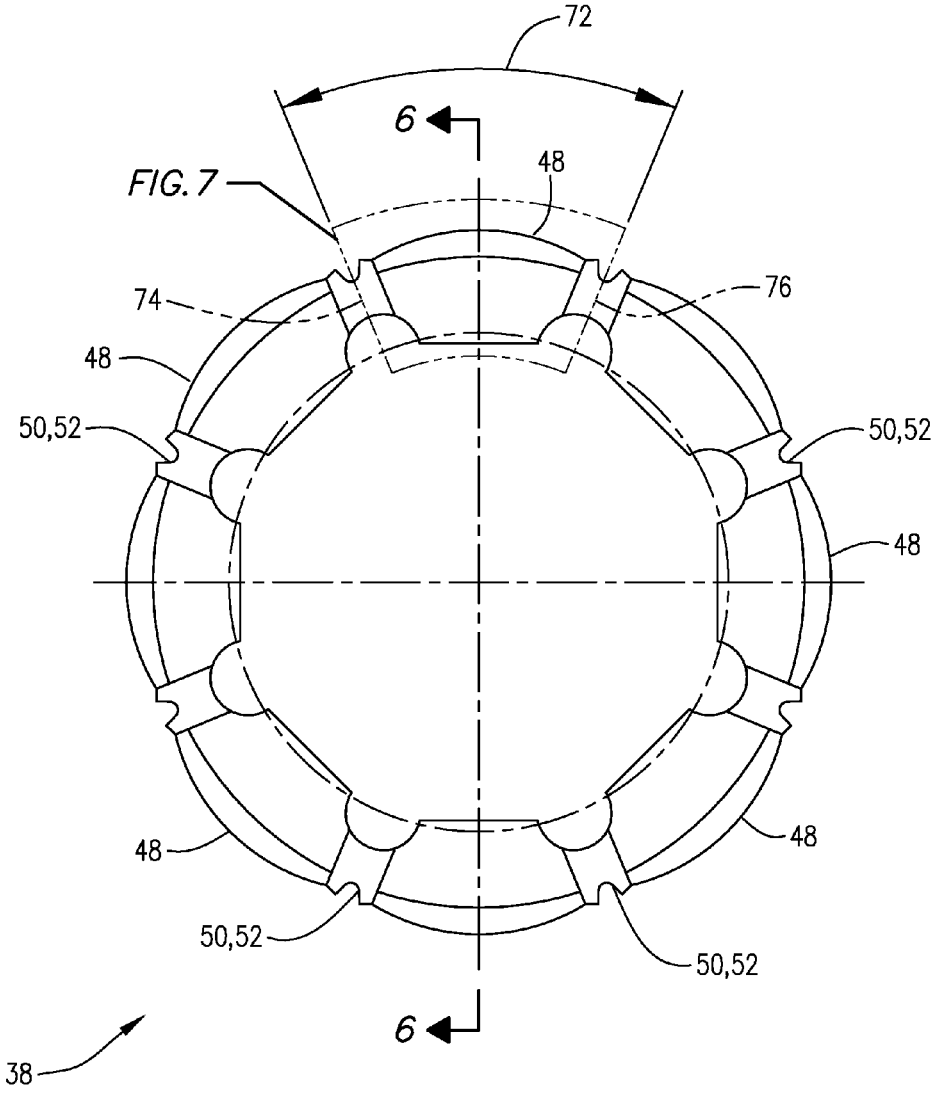
FIG. 8 is an enlargement of a slip segment of the embodiment of FIGS. 3-6. The slip segment is shown having a wicker having a peak and is shown in contact with a casing.
Figure 7:
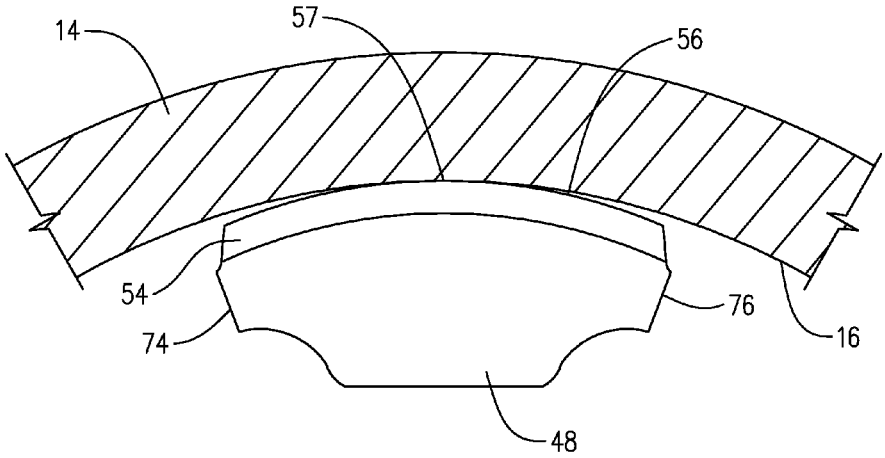
FIG. 7 is an enlargement of a slip segment of the embodiment of FIGS. 3-6. The slip segment is shown having a wicker having a standard radius and is shown in contact with a casing.
Figure 8:
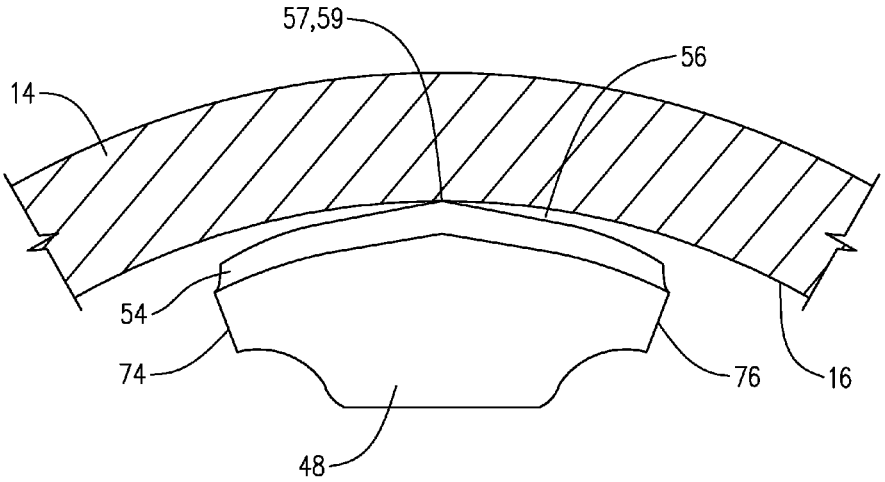
Figure 11:
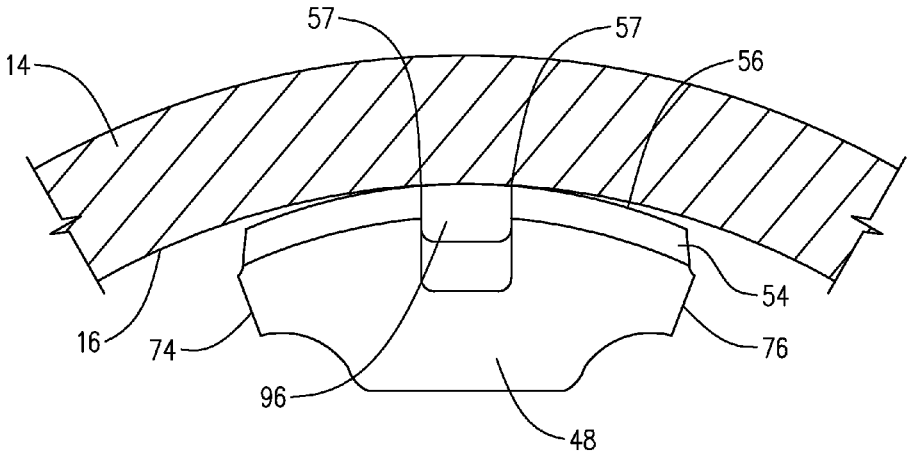
FIG. 11 is an enlargement of a slip segment of the embodiment of FIG. 10. The slip segment is shown having a wicker having a sub-standard radius and is shown in contact with a casing.

In accordance with the above description, the initial bite area or contact point 57 of cutting edge 56 is less than a third of the circumferential length of cutting edge 56 across slip segment 48 and contacts the casing inner wall 16 before other portions of the wicker. Preferably, the initial bite area or contact point 57 is less than a forth of the circumferential length of cutting edge 56. Generally, this bite area will be in the central one-third or central quarter section of cutting edge 56. Preferably, the bite area will be a set of contact points, with one or two such contact points being more preferable. As can be seen in FIGS. 7, 8 and 11, contact point 57 can be a single contact point or a double contact point located at or near the longitudinal or axial centerline 49 of slip segment 48, which contacts the casing inner wall 16 before portions of the cutting edge 56 at or near the groove.\. By "at or near the centerline" it is meant within about one-fourth of cutting edge length to either side of centerline 49, and more preferably within one-sixth of the cutting edge length to either side of centerline 49 and more preferably within in one-eighth of the cutting edge length to either side of the centerline 49. Where there is a single contact point 57 on cutting edge 56, it is more preferable that contact point 57 be located at or adjacent to centerline 49. By "at or near the groove" it is generally meant that portion of the cutting edge 56 which is not at or near the centerline and preferably includes at least that portion of the cutting edge 56 which is within about one-fourth the cutting edge length from the groove 50 and fracture channel 52.

Figure 9:
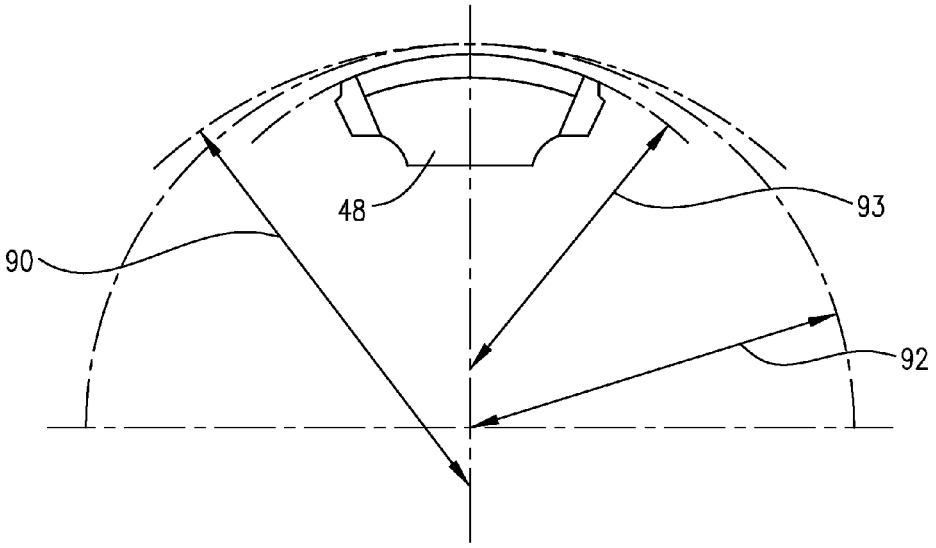
FIG. 9 is a detailed view of a slip segment of the embodiments of FIGS. 3-6, illustrating the substandard radius.

Turning now to FIGS. 5, 7 and 9, a contact point 57 is provided for on cutting edge 56 by adjusting the curvature of cutting edge 56. As can best be seen in FIG. 9, inner wall 16 of casing 14 has a circular curvature with a radius 90. As can best be seen from FIGS. 5 and 9, prior to separation of slip segment 48, outer surface 120 of slip ring 38 has an overall circular shape such that it forms a generally circular curvature with a radius 92. Thus, slip segments 48 make up a generally circular slip ring 38 with each slip segment making up a portion of the circle represented by angle 72 between first slip segment edge 74 and second slip segment edge 76. Generally, there will be at least two slip segments 48 and thus angle 72 will be 180° or less. As illustrated in FIG. 5, angle 72 is about 45°.

In order to provide for contact point 57, cutting edge 56 has an arcuate or circular curvature which differs from the overall circular shape of the slip ring. Generally cutting edge 54 can have an arcuate or circular curvature having a radius 93 less than the radius 90 of inner wall 16. Generally, radius 93 can be less than or equal to radius 92 of the overall circular shape of the slip ring and preferably is less than radius 92 of the slip ring. Typically, the radius 93 can be at least 3% shorter than radius 90 of inner wall 16 and generally will be no more than 10% shorter than radius 90 of inner wall 16, can be at least 5% shorter than radius 90 and can be no more than 8% shorter than radius 90. Thus, upon separation, cutting edge 56 will meet inner wall 16 at a contact point 57. As illustrated in FIG. 8, cutting edge 56 can be defined by two intersecting arcs having differing center points such that a generally pointed cutting edge is formed having a peak 59, which is also contact point 57.

As will be understood, each wicker 54 will generally have a cutting edge 56 having a contact point 57. Thus, in the case of the embodiment illustrated in FIG. 3-7, there will be five wickers on each slip segment 48 with each wicker having a cutting edge 56 with a contact point 57. Accordingly, there will be five contact points per slip segment. The contact points across the wickers on a slip segment can be aligned to be in the same position relative to centerline 49 or can be staggered so as to vary in distance from centerline 49. As will be appreciated, the reduction of the bite service area from substantially the entire area of the five cutting edges to five contact points substantially reduces the force need to bite into the casing.

Figure 10:
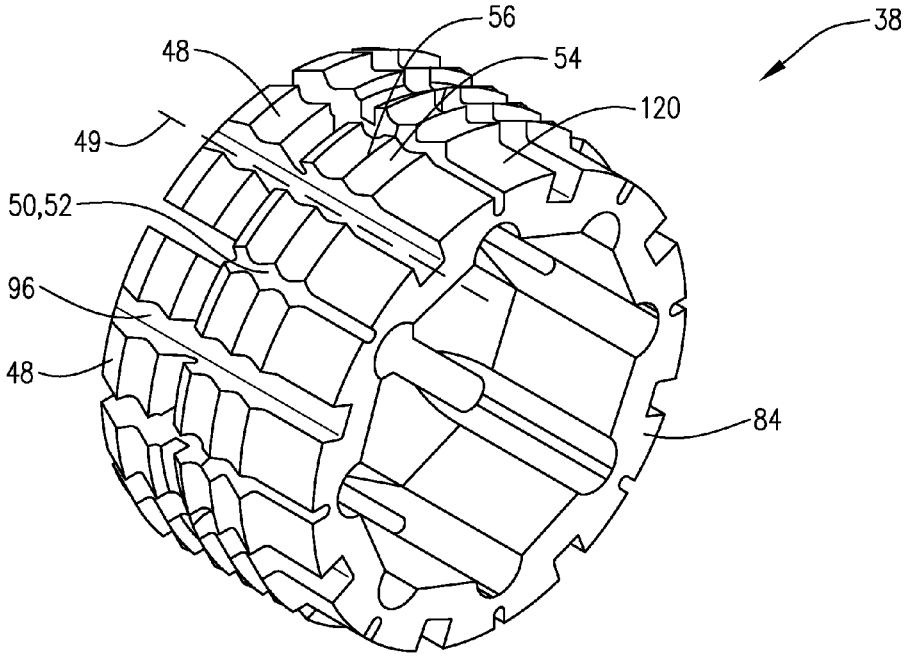
FIG. 10 is a bottom perspective view of a slip ring in accordance with another embodiment of the current invention.

Turning now to FIGS. 10 and 11, an alternative embodiment of slip ring 38 illustrated in FIG. 3 is depicted. In the alternative version of slip ring 38, additional longitudinal channels 96 are defined on each cutting edge of each wicker 54. Generally, longitudinal channels 96 will not be fracture channels; that is, they will not be designed to fracture under the force and pressures exerted on the slip ring while in use downhole. Each longitudinal channel 96 is defined by a pair of edges, first edge 97 and second edge 98. Longitudinal channel 96 run along the centerline 49 of slip segment 48 and divides wicker 54. Longitudinal channel 96 provide for additional non-continuous wicker segments and, thus creates two contact points 57 on cutting edge 56. One located at first edge 97 and one located at second edge 98.

Figure 12:
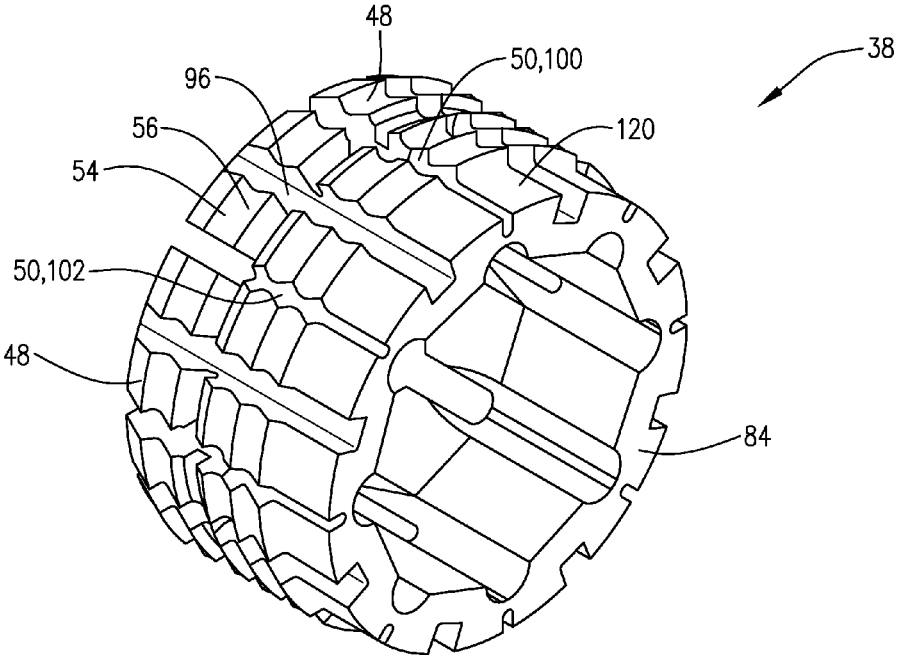
FIG. 12 is a bottom perspective view of a slip ring in accordance with yet another embodiment of the current invention.
Figure 13:
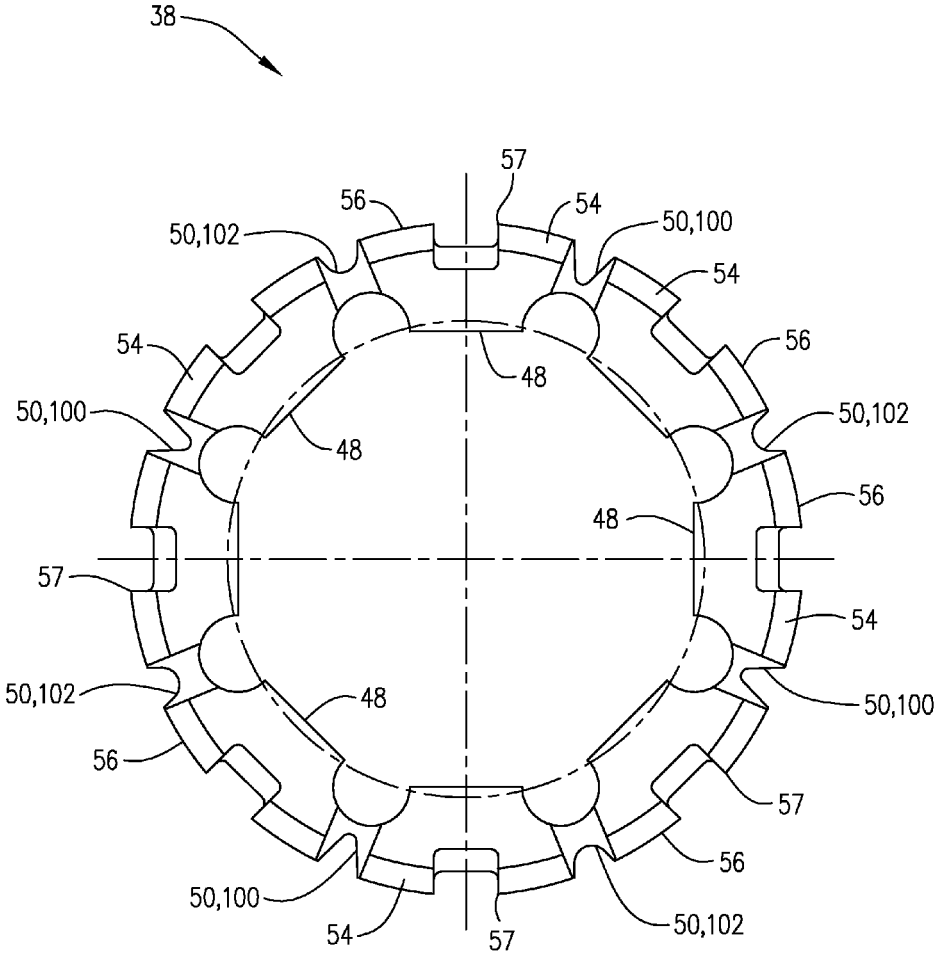
FIG. 13 is a top view of the slip ring in accordance with the embodiment of FIG. 12.
Figure 14:
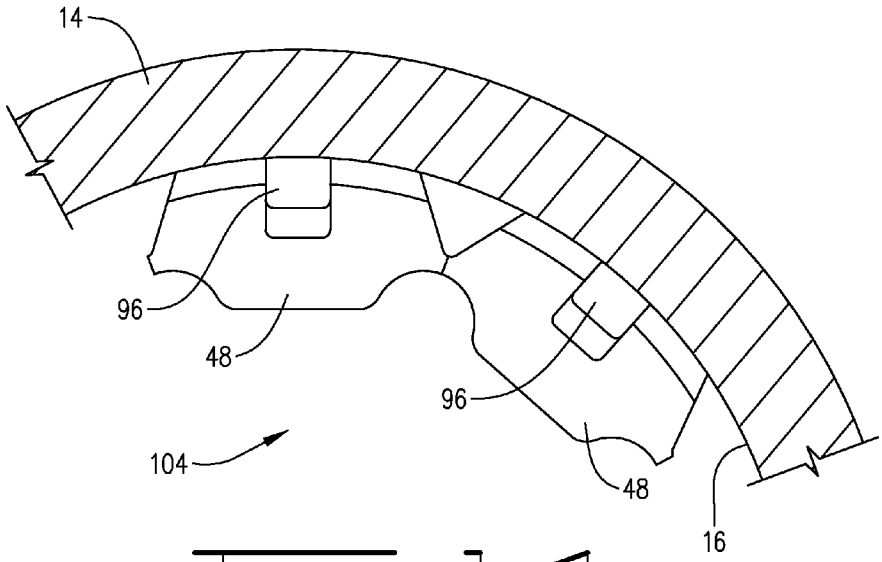
FIG. 14 is an enlargement of a slip segment of the embodiment of FIGS. 12 and 13. The slip segment is shown having a wicker having a casing radius and is shown in contact with a casing.

Another embodiment of the invention is illustrated in FIGS. 12-14. A first portion of grooves 50 are primary fracture channels 100. A second portion of grooves 50 are secondary fracture channels 102. Primary fracture channels 100 fracture upon application of a predetermined primary radial force. Secondary fracture channels fracture upon application of a predetermined secondary radial force, which is greater than the predetermined primary radial force. Fracture channels 100 and 102 are configured so that upon application of the predetermined primary radial force the slip segments 48 split into segment pairs 104, as can be best seen in FIG. 14. Thus, it can be determined which sections will be in pairs.

In one embodiment illustrated in FIG. 14, the pairs of segments are configured such that the radius of cutting edge cutting edge 56 for each wicker on a pair is able to be evenly set against casing inner wall 16. Thus, each cutting edge is nearly equal in the force exerted upon the casing inner wall 16. This can be achieved by having each cutting edge lay along a circle having a radius equal to the radius of casing inner wall 16. Generally, this embodiment will be useful in casings with hardness of less than P-100 grade.

Figure 15:
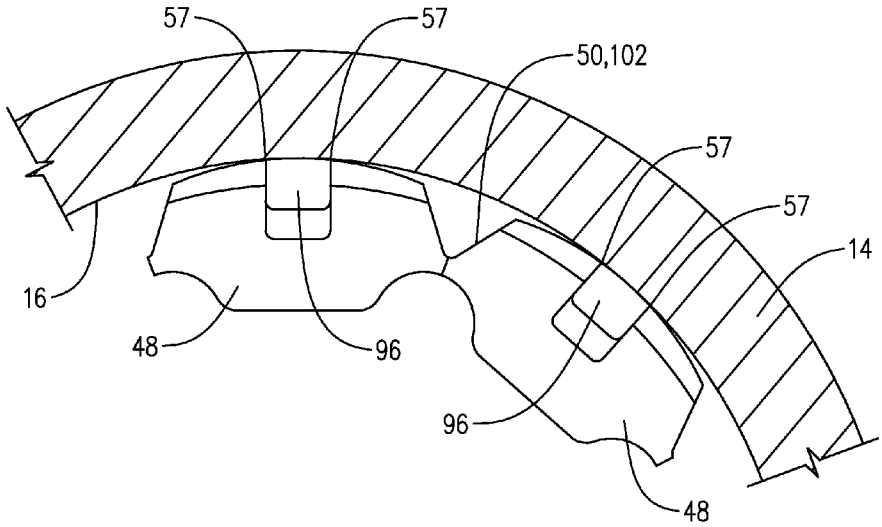
FIG. 15 is an enlargement of a slip segment of the embodiment of FIGS. 12 and 13. The slip segment is shown having a wicker having a sub-standard radius and is shown in contact with a casing.
Figure 15:
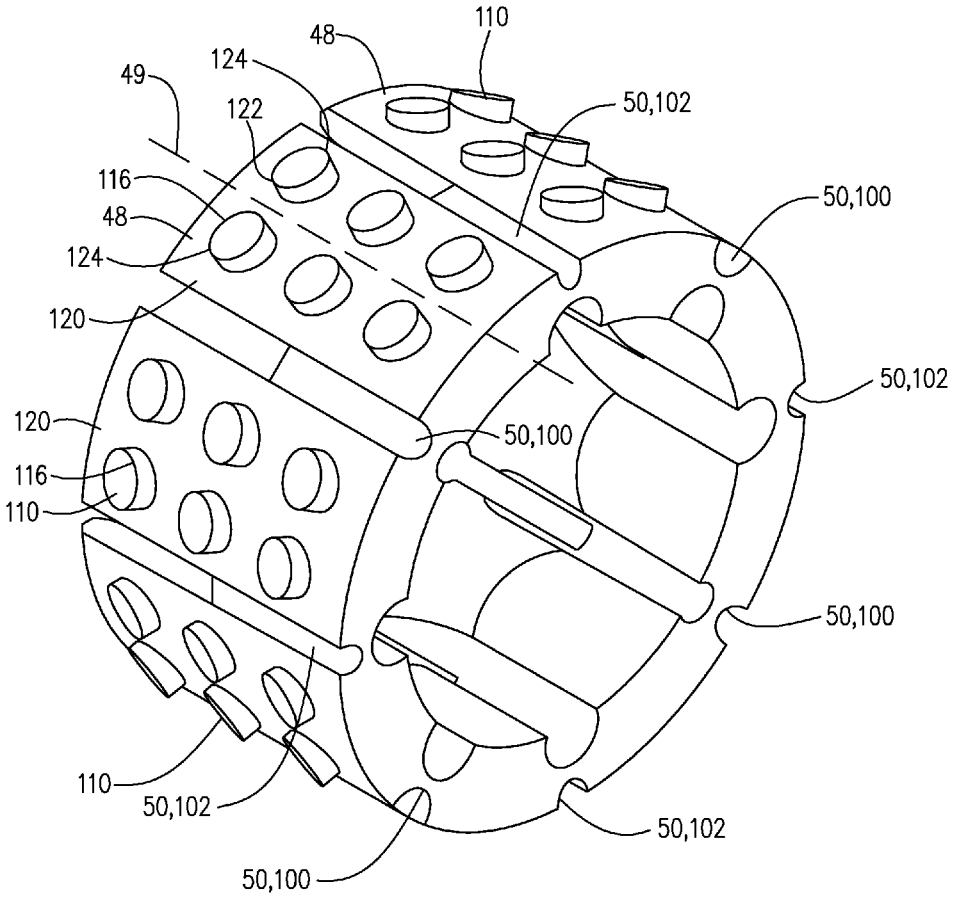

In the embodiment illustrated in FIG. 15, each cutting edge is designed with contact points 57 as described above. Thus, each pair initially bite into the casing at contact points 57 such that each pair initially bites into the casing at or near the centerline instead of at the portion of the cutting edge 56 at or near the groove. Generally, this embodiment will be useful in casings with hardness of P-100 grade or higher.

Figure 17:
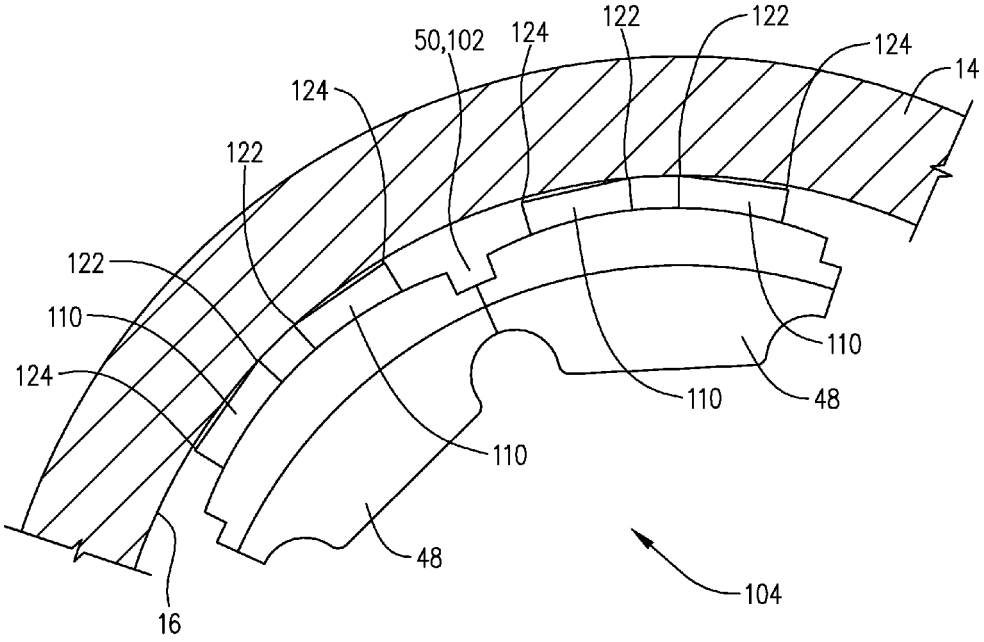
FIG. 17 is an enlargement of a slip segment of the embodiment of FIG. 16. The slip segment is shown having a wicker having a casing radius and is shown in contact with a casing.

In the embodiment illustrated in FIGS. 16 and 17, the slip rings use a plurality of inserts or buttons 110 as anchors instead of wickers. Buttons 110 are secured to outer surface 120 of slip ring 38 by adhesive, or by other means known to those skilled in the art. Buttons 110 extend radially outward from outer surface 54, and are positioned to engage casing 14, or in particular, an inner wall 16 of casing 14, in response to the predetermined primary radial force. There is at least one button 110 secured to and carried by each slip segment 48 of slip ring 38. Generally, there will be multiple circumferential pairs of buttons carried by each slip segment 48, as illustrated. The circumferential pairs of button comprise inner button 112 and outer button 114.

Buttons 110 are comprised of a material having sufficient hardness to penetrate or bite into casing 14. Each button 110 has button edge 116 defining the point of engagement for button 58 with casing 14. Segment pairs 104 are configured such that the buttons 110 initially bite into casing 14 at the portion 122 of button edge 116 closest to centerline 49 or segment pair center 118, instead of along the portion 124 of button edge 116 closest to secondary fracture channel 102 or primary fracture channel 100.

Preferably, buttons 110 are made from a material selected from the group consisting of tungsten carbide, ceramic, metallic-ceramic, zirconia-ceramic titanium, molybdenum, nickel and combinations thereof. Additionally, buttons 110 may be, for example, similar in material and form as those described in U.S. Pat. No. 5,984,007, which is incorporated by reference herein. Buttons 110 may be made from any material that can pierce the casing or is harder than the casing grade utilized for casing 14.

In operation, downhole tool 18 is introduced into the wellbore and casing 14. Downhole tool 18 is then positioned at the desired depth or location by a setting tool, such as a wireline. The wireline exerts an initial or setting force upon slip assembly 36, causing slip wedge 40 and slip ring 38 to move relative to one another, which exerts a radial force upon slip ring 38. Slip wedge 40 has inclined surface 42 defined thereon. Slip ring 38 radially expands outward as complementary second surface 44 slides against inclined first surface 42 of slip wedge 40. The sliding effect of complementary second surface 44 against inclined first surface 42 causes slip ring 38 to force cutting edge 56 of wickers 54 defined on slip segment 48 against casing inner wall 16. As the radial force is increased, contact point 57 of cutting edge 56 of wickers 54 bite into casing inner wall 16. As the force continues or increases, the remaining part of wickers 54 penetrate into casing inner wall 16, thus setting downhole tool 18. Additionally, where segment pairs 104 have been used, the setting force is sufficient to result in the radial force exerted on slip ring 38 being at least equal to the predetermined primary radial force but generally less than the predetermined secondary radial force. After the contact points 57 have bit into the casing, wickers 54 can be fully set into the casing under operation of a radial force less than the predetermined secondary radial force or the radial force can be increased to or above the predetermined secondary force. Thus, fraturing the secondary fracture channels during setting of the remaining portion of wickers 54.

Other embodiments of the current invention will be apparent to those skilled in the art from a consideration of this specification or practice of the invention disclosed herein. Thus, the foregoing specification is considered merely exemplary of the current invention with the true scope thereof being defined by the following claims.

What is claimed is:

1. A slip ring for anchoring a downhole tool in a wellbore casing having an inner wall, said slip ring comprising:

two or more slip segments integrally formed into said slip ring, wherein each slip segment has an outer surface;

two or more grooves are on the slip ring and one groove is longitudinally positioned between said slip segments, wherein a first portion of said grooves define fracture channels such that said slip segments are frangiblely connected together and said slip segments will separate along said first portion of said grooves upon application of a predetermined primary radial force; and a plurality of generally circumferentially extending wickers upon each said outer surface wherein each wicker has a cutting edge; and wherein each slip segment has a longitudinally extending centerline; and wherein each slip segment and each wicker is configured such that, upon expansion of said slip ring in said casing, a contact point on said cutting edge and at or near said centerline will meet said casing before any portion of said cutting edge at or near said groove.

2. The slip ring of claim 1, wherein said contact point is on the center one-third circumferential portion of each slip segment.

3. The slip ring of claim 1, wherein said casing has an inner cylindrical surface and each said wicker is arcuate and has a radius no less than 3% shorter than the radius of said inner surface of said casing.

4. The slip ring of claim 1, further comprising a longitudinal channel defined by a pair of channel edges and running along said centerline, wherein said longitudinal channel divides said wicker in two and wherein there are two contact points located on each channel edge.

5. The slip ring of claim 1, wherein a second portion of said grooves define fracture channels, which will separate upon application of a predetermined secondary radial force, wherein said predetermined secondary radial force is greater than said predetermined primary radial force and said first portion of said grooves and second portion of said grooves are positioned such that, on application of said predetermined primary radial force, said slips segments separate into pairs of slip segments.

6. The slip ring of claim 5, wherein said contact point is on the center one-third circumferential portion of each slip segment.

7. The slip ring of claim 6, further comprising a longitudinal channel defined by a pair of channel edges and running along said centerline, wherein said longitudinal channel divides said wicker in two and wherein there are two contact points located on each channel edge.

8. A method of anchoring a downhole tool in a wellbore casing comprising:

introducing said downhole tool into said casing wherein said downhole tool has a mandrel, a slip ring positioned on said mandrel and a slip wedge positioned on said mandrel, wherein said slip ring comprises:

two or more slip segments integrally formed into said slip ring to produce a central aperture adapted to receive said mandrel, said slip segments having an outer surface and;

two or more grooves are on the slip ring and one groove is longitudinally positioned between said slip segments, wherein a first portion of said grooves define fracture channels such that said slip segments are frangiblely connected together and said slip segments will separate along said first portion of said grooves upon application of a predetermined primary radial force; and a plurality of generally circumferentially extending wickers upon said outer surface wherein each wicker has a cutting edge; and wherein each slip segment has a longitudinally extending centerline; and wherein each slip segment and each wicker is configured such that, upon expansion of said slip ring in said casing, a contact point on said cutting edge and at or near said centerline will meet said casing before any portion of said cutting edge at or near said groove;

positioning said downhole tool at a desired location;

applying a setting force to said downhole tool such that said slip wedge engages said slip ring so as to provide a radial force at least equal to said predetermined primary radial force to said slip ring and thus causing said contact point to penetrate said casing; and increasing said radial force applied to said slip ring such that the majority of said cutting edge penetrates said casing.

9. The method of claim 8, wherein said casing has an inner cylindrical surface and each said wicker is arcuate and has a radius no less than 3% shorter than the radius of said inner surface of said casing.

10. The method of claim 9, further comprising a longitudinal channel defined by a pair of channel edges and running along said centerline, wherein said longitudinal channel divides said wicker in two and wherein there are two contact points located on each channel edge.

11. The method of claim 8, wherein said second portion of said grooves define fracture channels, which will separate upon application of a predetermined secondary radial force, wherein said predetermined secondary radial force is greater than said predetermined primary radial force and said first portion of said grooves and second portion of said grooves are positioned such that, on application of said predetermined primary radial force, said slips segments separate into pairs of slip segments.

12. The method of claim 11, wherein said contact point is on the center one-third circumferential portion of each slip segment.

13. The method of claim 12, further comprising a longitudinal channel running along said centerline which divides said wicker in two and wherein there are two contact points located on each channel edge and wherein in the step of applying a setting force, each of said two contact points penetrate said casing.

14. A slip ring for anchoring a downhole tool in a wellbore casing having an inner wall, said slip ring comprising:

four or more slip segments integrally formed into said slip ring, wherein each slip segment has an outer surface;

two or more primary grooves are on the slip ring and one primary groove is longitudinally positioned between said slip segments wherein said primary grooves define fracture channels such that said slip segments are frangiblely connected and said slip segments will separate along said primary grooves into pairs upon application of a predetermined primary radial force;

two or more secondary grooves are on the slip ring and one secondary groove is longitudinally positioned between said slip segments forming said pairs, wherein said secondary grooves define fracture channels such that said pairs of slip segments are frangiblely connected and will separate upon application of a predetermined secondary radial force and wherein said predetermined secondary radial force is greater than said predetermined primary radial force; and a plurality anchors upon said outer surface; and wherein each slip segment has a longitudinally extending centerline; wherein each slip segment and each anchor is configured such that, upon expansion of said slip ring by said predetermined primary radial force in said casing, said anchors at or near the centerline will meet said inner wall of said casing; and wherein said slip segments are configured such that a portion of said anchors along said longitudinal extending centerline will meet said inner wall of said casing prior to any other portion of said anchors.

15. The slip ring of claim 14 wherein said anchors are generally circumferentially extending wickers and each wicker has a cutting edge and wherein each slip segment and each wicker is configured such that, upon expansion of said slip ring in said casing, a contact point on said cutting edge and at or near said centerline will meet said casing before any portion of said cutting edge at or near said groove.

16. The slip ring of claim 15, wherein said contact point is on the center one-third circumferential portion of each slip segment.

17. The slip ring of claim 16, further comprising a longitudinal channel defined by a pair of channel edges and running along said centerline, wherein said longitudinal channel divides said wicker in two and wherein there are two contact points located on each channel edge.

18. A method of anchoring a downhole tool in a wellbore casing comprising:

introducing said downhole tool into said casing wherein said downhole tool has a mandrel, a slip ring positioned on said mandrel and a slip wedge positioned on said mandrel, wherein said slip ring comprises:

four or more slip segments integrally formed into said slip ring, wherein each slip segment has an outer surface;

two or more primary grooves are on the slip ring and one primary groove is longitudinally positioned between said slip segments wherein said primary grooves define fracture channels such that said slip segments are frangiblely connected and said slip segments will separate along said primary grooves into pairs upon application of a predetermined primary radial force;

two or more secondary grooves are on the slip ring and one secondary groove is longitudinally positioned between said slip segments forming said pairs wherein said secondary grooves define fracture channels such that said pairs of slip segments are frangiblely connected and will separate upon application of a predetermined secondary radial force wherein said predetermined secondary radial force is greater than said predetermined primary radial force; and a plurality anchors upon said outer surface; and wherein each slip segment has a longitudinally extending centerline; and wherein each slip segment and each anchor is configured such that, upon expansion of said slip ring by said predetermined primary radial force in said casing, said anchors at or near the centerline will meet said inner wall of said casing; and wherein said anchors are generally circumferentially extending wickers and each wicker has a cutting edge and wherein each slip segment and each wicker is configured such that, upon expansion of said slip ring in said casing, a contact point on said cutting edge and at or near said centerline will meet said casing before any portion of said cutting edge at or near said groove;

positioning said downhole tool at a desired location; and applying a first setting force to said downhole tool such that said slip wedge engages said slip ring so as to provide a radial force at least equal to said predetermined primary radial force to said slip ring and thus causing said anchors to penetrate said casing.

19. The slip ring of claim 18, wherein said contact point is on the center one-third circumferential portion of each slip segment.

20. The slip ring of claim 19, further comprising a longitudinal channel defined by a pair of channel edges and running along said centerline, wherein said longitudinal channel divides said wicker in two and wherein there are two contact points located on each channel edge and wherein in the step of applying a first setting force, each of said two contact points penetrate said casing.

21. The method of claim 20 further comprising increasing said radial force applied to said slip ring such that the majority of said cutting edge penetrates said casing.

22. The method of claim 18 further comprising applying a second setting force to said downhole tool to provide a radial force at least equal to said predetermined secondary radial force to said slip ring so as to separate said slip segments along said secondary grooves and thus causing said anchors to further penetrate said casing.

* * * * *